US008801872B2

(12) United States Patent
Wright et al.

(10) Patent No.: US 8,801,872 B2
(45) Date of Patent: Aug. 12, 2014

(54) SECONDARY-HARDENING GEAR STEEL

(75) Inventors: James A. Wright, Chicago, IL (US); Jason Sebastian, Chicago, IL (US)

(73) Assignee: QuesTek Innovations, LLC, Evanston, IL (US)

( * ) Notice: Subject to any disclaimer, the term of this patent is extended or adjusted under 35 U.S.C. 154(b) by 0 days.

(21) Appl. No.: 12/194,964

(22) Filed: Aug. 20, 2008

(65) Prior Publication Data

US 2009/0199930 A1 Aug. 13, 2009

Related U.S. Application Data

(60) Provisional application No. 60/957,307, filed on Aug. 22, 2007.

(51) Int. Cl.

| | |
|---|---|
| ***C23C 8/22*** | (2006.01) |
| ***C22C 5/02*** | (2006.01) |
| ***C22C 38/08*** | (2006.01) |
| ***C22C 38/00*** | (2006.01) |
| ***C23C 8/32*** | (2006.01) |
| ***C23C 8/20*** | (2006.01) |
| ***C22C 38/12*** | (2006.01) |
| ***C22C 38/14*** | (2006.01) |
| ***C22C 38/22*** | (2006.01) |
| ***C22C 38/50*** | (2006.01) |
| ***C22C 38/46*** | (2006.01) |
| ***C22C 38/40*** | (2006.01) |
| ***C22C 38/30*** | (2006.01) |
| ***C22C 38/18*** | (2006.01) |
| ***C21D 1/22*** | (2006.01) |
| ***C21D 6/00*** | (2006.01) |
| ***C22C 38/52*** | (2006.01) |
| ***C22C 38/44*** | (2006.01) |
| ***C21D 6/02*** | (2006.01) |
| ***C21D 6/04*** | (2006.01) |
| ***C21D 9/32*** | (2006.01) |
| *C21D 1/25* | (2006.01) |

(52) U.S. Cl.

CPC . *C22C 38/44* (2013.01); *C21D 1/22* (2013.01); *C21D 2211/008* (2013.01); *C21D 6/004* (2013.01); *C21D 1/25* (2013.01); *C22C 38/52* (2013.01); *C21D 6/02* (2013.01); *C21D 6/04* (2013.01); *C21D 9/32* (2013.01); *C21D 6/007* (2013.01)

USPC ..... 148/319; 148/405; 148/336; 148/328; 148/320; 148/316; 420/127; 420/126; 420/124; 420/123; 420/122; 420/119; 420/114; 420/113; 420/112; 420/111; 420/110; 420/109; 420/108; 420/107; 420/105; 420/104; 420/8

(58) Field of Classification Search

None

See application file for complete search history.

(56) References Cited

U.S. PATENT DOCUMENTS 2,147,119 A * 2/1939 Emmons ..... 420/111
4,157,258 A 6/1979 Philip et al.

(Continued)

FOREIGN PATENT DOCUMENTS

GB 1243382 * 8/1971 ..... C22C 39/20
JP J5-239602 A 9/1993

(Continued)

OTHER PUBLICATIONS

Hardness Conversion Chart (Technical Resources for Manufacturing Professionals, CarbideDepot.com, last visited Mar. 24, 2010).*

(Continued)

*Primary Examiner* — Yoshitoshi Takeuchi

(74) *Attorney, Agent, or Firm* — Banner & Witcoff, Ltd.

(57) ABSTRACT

A case hardened gear steel having enhanced core fracture toughness includes by weight percent about 16.3Co, 7.5Ni, 3.5Cr, 1.75Mo, 0.2W, 0.11C, 0.03Ti, and 0.02V and the balance Fe, characterized as a predominantly lath martensitic microstructure essentially free of topologically close-packed (TCP) phases and carburized to include fine $M_2C$ carbides to provide a case hardness of at least about 62 HRC and a core toughness of at least about 50 ksi√in.

8 Claims, 5 Drawing Sheets

(56) References Cited

U.S. PATENT DOCUMENTS

| | | | | |
|---|---|---|---|---|
| 6,176,946 | B1 | 1/2001 | Kuehmann et al. | |
| 6,221,183 | B1 * | 4/2001 | Sato et al. | 148/505 |
| 6,379,475 | B1 | 4/2002 | Kuehmann | |
| 6,458,220 | B1 | 10/2002 | Kuehmann et al. | |
| 6,464,801 | B2 * | 10/2002 | Kuehmann et al. | 148/319 |
| 6,485,582 | B1 | 11/2002 | Kuehmann et al. | |
| 6,491,767 | B1 | 12/2002 | Kuehmann | |
| 6,635,126 | B2 | 10/2003 | Kuehmann et al. | |
| 6,695,930 | B2 | 2/2004 | Kuehmann et al. | |
| 7,160,399 | B2 | 1/2007 | Kuehmann et al. | |
| 7,235,212 | B2 | 6/2007 | Kuehmann et al. | |
| 2007/0199625 | A1 | 8/2007 | Sachdev et al. | |
| 2008/0145690 | A1 | 6/2008 | Mukherji et al. | |

FOREIGN PATENT DOCUMENTS

| | | | | |
|---|---|---|---|---|
| JP | 2002-501984 | A | 1/2002 | |
| WO | 9939017 | A1 | 5/1999 | |
| WO | 99/39017 | A1 | 8/1999 | |
| WO | WO 03/018856 | * | 3/2003 | |
| WO | 03/076676 | A2 | 9/2003 | |
| WO | WO 03/076676 | * | 9/2003 | C22C 38/00 |
| WO | 03/018856 | A2 | 3/2008 | |

OTHER PUBLICATIONS

Elgun, "Case Hardening Methods," http://info.lu.farmingdale.edu/depts/met/met205/casehardening.html (1999).*
International Search Report Application No. PCT/US2008/073966, dated Jun. 15, 2009.
Charles J. Kuehmann et al., Gear Steels Designed by Computer, Article, May 1998, pp. 41-43, Advanced Materials & Processes.
G.B. Olson, Morris Cohen: A memorial tribute, Article, Feb. 5, 2006, pp. 2-11, Materials Science & Engineering.
A. Saha et al., Computer-aided design of transformation toughened blast resistant naval hull steels: Part I, Article, 2007, pp. 177-200, Springer-Science+ Business Media B.V.
A. Saha et al., Prototype evaluation of transformation toughened blast resistant naval hull steels: Part II, Article, 2007, pp. 201-233, Springer-Science+ Business Media B.V.
G.B. Olson, Advances in theory: Martensite by design, Article, Feb. 7, 2006, pp. 48-54, Materials Science and Engineering.
Campbell, "Systems Design of High Performance Stainless Steels", Jun. 1997, pp. 1-265.
Krantz and Tufts, Pitting and Bending Fatigue Evaluations of a New Case-Carburized Gear Steel, Gear Technology, Mar./Apr. 2008, www.geartechnology.com, pp. 1-6.
Sebastian, Isheim, and Seidman, "Atom-Probe Analyses of Carbide-Containing Steels-Comparison of Laser-and Voltage-Pulsed Results", Jul. 31, 2006, pp. 1-2.
Tiemens, "Performance Optimization and Computational Design of Ultra-High Strength Gear Steels", Dec. 2006, pp. 1-208.
Tufts, "Advanced Steels for Affordable CVT Technology", Dec. 2001, pp. 1-92.
Wright, "Design Principles for Advanced Carburized Bearing Steels", Jun. 2003, pp. 1-147.
Qian, "Residual Stress Control and Design of Next-Generation Ultra-hard Gear Steels", Jun. 2007, pp. 1-219.
International Preliminary Report on Patentability and Written Opinion of the International Searching Authority of Application No. PCT/US2008/073966 dated Jun. 23, 2010.
Canadian Office Action, Application No. 2,695,472, issued Jul. 4, 2012.
Canadian Office Action, Application No. 2,695,472, issued Sep. 6, 2011, 3pp.
Japanese Office Action, Patent Application No. JP 2010-522059 issued Oct. 1, 2013.
Japanese Office Action, Patent Application No. JP 2010-522059 issued May 21, 2013.
Abstract of corresponding document WO9939017 (A1) is attached as translation.
European Office Action, Patent Application No. 08843244.8 issued May 2, 2014.

* cited by examiner

SECONDARY-HARDENING GEAR STEEL

CROSS REFERENCE TO RELATED APPLICATION

This is a utility application based upon the following provisional application which is incorporated herewith by reference and for which priority is claimed: U.S. Ser. No. 60/957,307 filed Aug. 22, 2007.

GOVERNMENT INTERESTS

Activities relating to the development of the subject matter of this invention were funded at least in part by United States Government, Naval Air Warfare Center Contract No. N68335-06-C-0339, and thus may be subject to license rights and other rights in the United States.

BACKGROUND OF THE INVENTION

In a principal aspect, the present invention relates to a high-performance carburized gear steel that can improve the performance of rotorcraft power transmissions, due to a unique and useful combination of surface hardness and core toughness. The U.S. Navy estimates that a 20% increase in gear durability would provide an annual cost saving of $17 million to the Defense Logistics Agency. However, the rotorcraft industry has not adopted a new gear steel for over twenty years, and instead focused on surface processing optimizations such as laser-peening, super-finishing, and directional forging. Such processes are providing diminishing returns in durability improvements. The subject invention provides a solution complementary to process enhancements and enables high-performance gears having reduced size and weight which are capable of transmitting more power at increased operating temperatures.

Carburized X53 (U.S. Pat. No. 4,157,258) is the incumbent material in rotorcraft transmissions. Compared to X53, the subject invention places an emphasis on increasing the case strength and the core fracture toughness, as well as increasing the thermal stability up to 450° C. to provide hot hardness in high-temperature excursions. U.S. Pat. No. 6,464,801 also discloses case-hardened steels. However, the embodiment A1 of U.S. Pat. No. 6,464,801 shows limited surface-hardness, i.e., Rockwell C scale hardness (HRC) of 60-62. Another embodiment of U.S. Pat. No. 6,464,801, steel C3, shows a greater surface hardness of 69 HRC, but the core of this steel lacks toughness. To be usable as a gear, the core fracture toughness of the steel must exceed 50 ksi√in. Thus, there has developed a need for a carburized gear steel with a surface hardness of HRC of at least about 62-64 at a usable core toughness exceeding 50 ksi√in.

SUMMARY OF THE INVENTION

Briefly, the present invention comprises a high-performance gear steel which is especially useful for rotorcraft transmissions. The steel exhibits an increase in surface hardness and core fracture toughness compared to conventional carburized gear steels. The steel is designed for a reasonable carbide solvus temperature, which, in turn, enables gas or vacuum carburization. Upon gas quenching from the solution heat treatment temperature, the steel transforms into a predominantly lath martensitic matrix. During tempering, an optimal strengthening dispersion of secondary $M_2C$ carbide precipitates, where M is Mo, Cr, W and/or V. The high tempering temperature of the steel enables higher operating temperatures in transmission components compared to conventional gear steels like X53 or 9310.

To achieve high core toughness, the matrix composition is carefully balanced to ensure the ductile-to-brittle transition is sufficiently below room temperature. The designed composition also effectively limits the thermodynamic driving force for precipitation of embrittling Topologically-Close-Packed (TCP) intermetallic phases such as σ and μ. Toughness of the invented steel is further enhanced by the distribution of a fine dispersion of grain-pinning particles that are stable during carburization and solution heat treatment cycles. The grain-pinning particles are MC carbides, where M=Ti, Nb, Zr, V with Ti preferred, that dissolve during homogenization and subsequently precipitate during forging.

TABLE I

| | wt % | | | | | | | | | | | |
|---|---|---|---|---|---|---|---|---|---|---|---|---|
| Alloy | Fe | Cr | Co | Mo | Ni | V | W | C | Ti | Mn | Si | Cu |
| C64 | Bal. | 3.5 | 16.3 | 1.75 | 7.5 | 0.02 | 0.2 | 0.11 | 0.03 | | | |
| Al | Bal. | 3.5 | 18.0 | 1.10 | 9.5 | 0.08 | 0.0 | 0.20 | 0.03 | | | |
| C2 | Bal. | 4.8 | 25.0 | 0.03 | 3.8 | 0.06 | 0.0 | 0.237 | | | | |
| C3 | Bal. | 5.0 | 28.0 | 1.75-2.50 | 3.25-3.15 | 0.025 | 0.0 | 0.05-0.18 | | | | |
| C69B | Bal. | 4.5 | 16.1 | 1.80 | 4.3 | 0.10 | 0.1 | 0.12 | 0.02 | | | |
| X53 | Bal. | 1.0 | 0.0 | 3.25 | 2.00 | 0.10 | 0.0 | 0.10 | | 0.35 | 1.00 | 2.00 |
| 9310 | Bal. | 1.2 | | 0.115 | 3.25 | | | 0.145 | | 0.55 | 0.25 | |

The exemplary steel of the invention is designated as C64 in the above table. By virtue of inclusion of W, this steel is distinct from the steels disclosed in U.S. Pat. No. 6,464,801 (i.e. A1, C2, and C3). Inclusion of W increases the $M_2C$ driving force similar to Cr or Mo, and uniquely limits the thermodynamic driving force for precipitation of undesirable TCP phases. Whereas Mo and Cr preferentially promote σ-phase more than μ-phase, W provides a reverse effect. Thus, by adding W, the total driving force for σ- and μ-phases is balanced and precipitation of either TCP phase is avoided.

Alloy C69B is a counterexample. Although alloy C69B does include W and successfully tends to avoid the precipitation of TCP phases, insufficient Ni in the matrix places the ductile-to-brittle transition above room temperature. The Ni content is thus greater in alloys of the embodiment of the invention to place the ductile-to-brittle transition below room temperature and concurrently maximize the driving force for $M_2C$, enabling the highest surface hardness at a usable toughness compared to any other known secondary-hardening steel.

Due to high surface hardness, good core toughness, and the high-temperature capability, the disclosed steel is considered especially utilitarian with respect to gears for helicopter transmissions. Other uses of the steel include vehicle gearing and armor. With respect to the constituents in the exemplary steel set forth above, the alloy preferably includes a variance in the constituents in the range of plus or minus five percent of the mean value.

BRIEF DESCRIPTION OF THE DRAWING

In the detailed description which follows, reference will be made to the drawing comprised of the following figures.

DESCRIPTION OF THE PREFERRED EMBODIMENT

Figure 1:
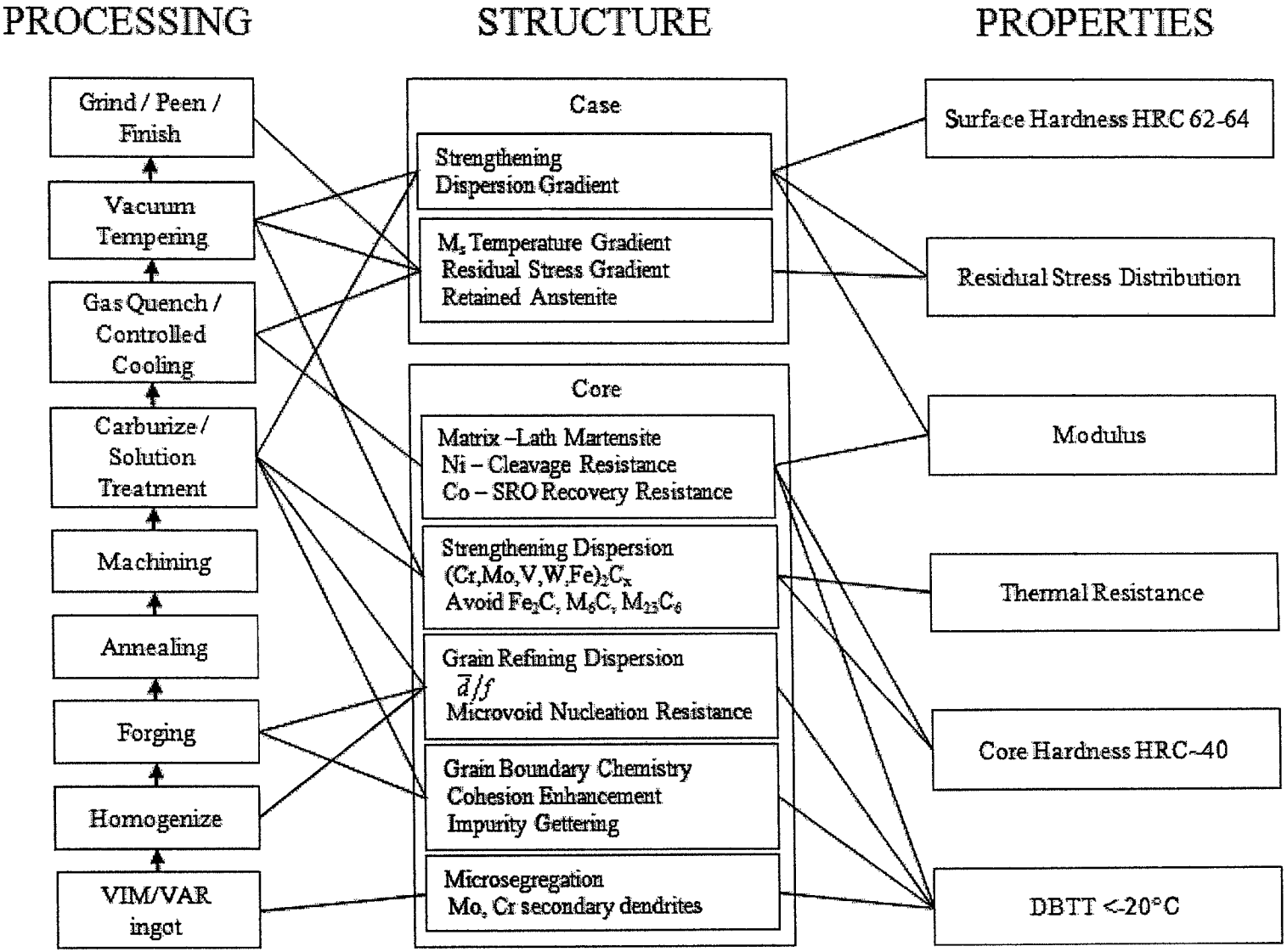
FIG. 1 is a systems design chart representing the interactions among the desired hierarchical microstructure, the required processing and the property objectives for the alloy of the invention.
Figure 2:
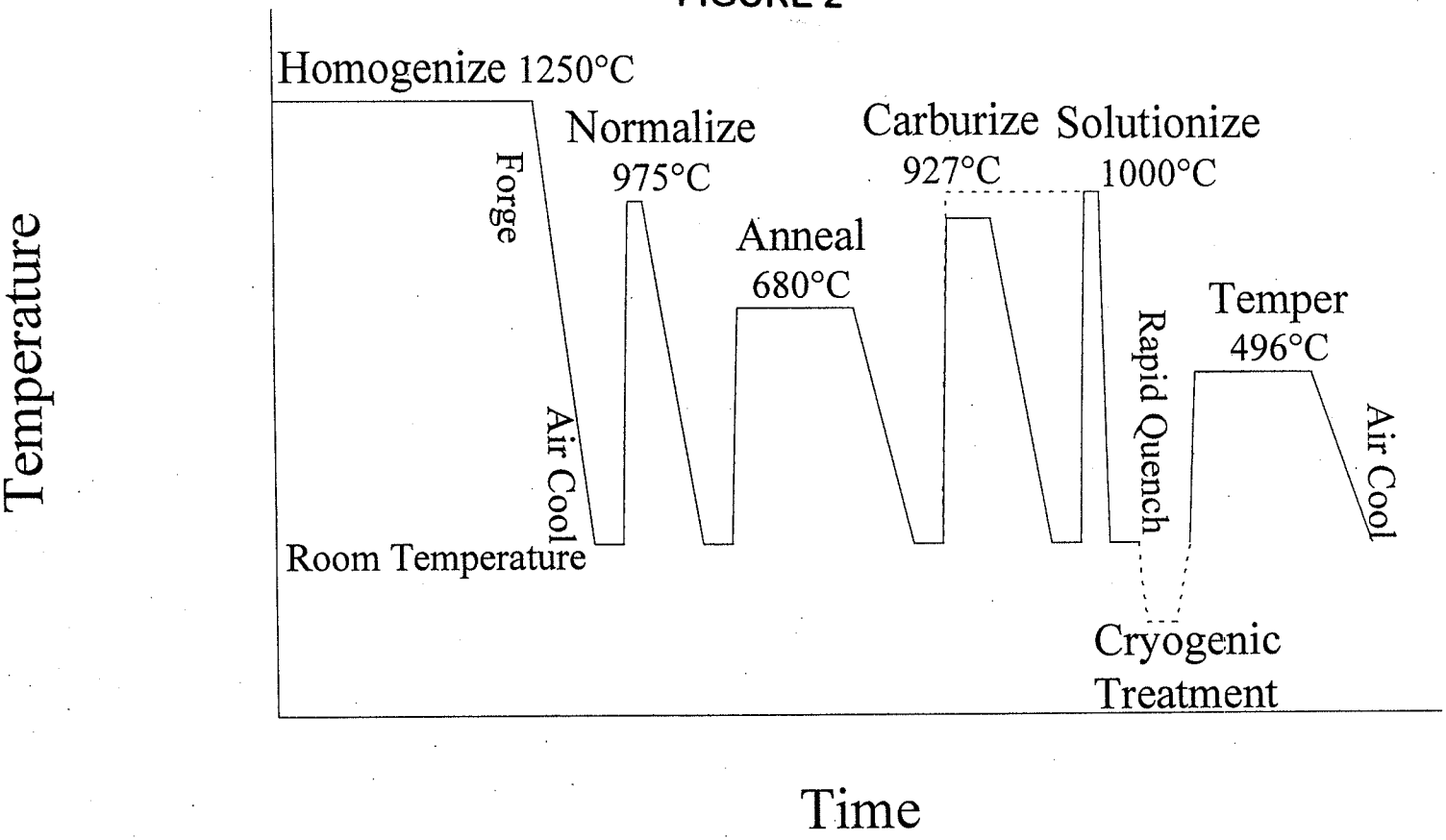
FIG. 2 schematically illustrates the time-temperature processing steps for the subject alloy.

In general, the subject matter of the invention comprises a secondary-hardening carburized gear steel with surface hardness of HRC of at least about 62-64 and core fracture toughness greater than about 50 ksi√in. The interactions among the desired hierarchical microstructure, the processing and the property objectives are represented by the systems design chart in FIG. 1. An ultimate goal of this invention was to optimize the whole system by controlling each subsystem and provide the most useful combination of surface hardness, core fracture toughness, and temperature resistance.

Failure modes in gears are generally grouped into three categories: bending fatigue, contact fatigue, and temperature-induced scoring. Bending fatigue as well as contact fatigue can be limited by a high surface-hardness. To achieve high surface-hardness, the steel of the invention employs efficient secondary hardening by coherent $M_2C$ carbides which precipitate during tempering. The high Co content of the steel retards dislocation recovery and reduces the density of dislocations in response to thermal exposure. $M_2C$ carbides precipitate coherently on these dislocations during tempering and provide a strong secondary hardening response, enabling a surface hardness of 62-64 HRC.

The steel alloy of the invention also limits temperature-induced scoring. Subsurface scoring results if the alloy's contact fatigue strength drops below the applied stress at any point below the surface. To provide adequate fatigue strength and avoid subsurface scoring, typically at least about a 1 mm-deep hardened case is preferred. The steel of the invention achieves this desirable case depth via a carbon content gradient achieved during carburization.

Figure 3:
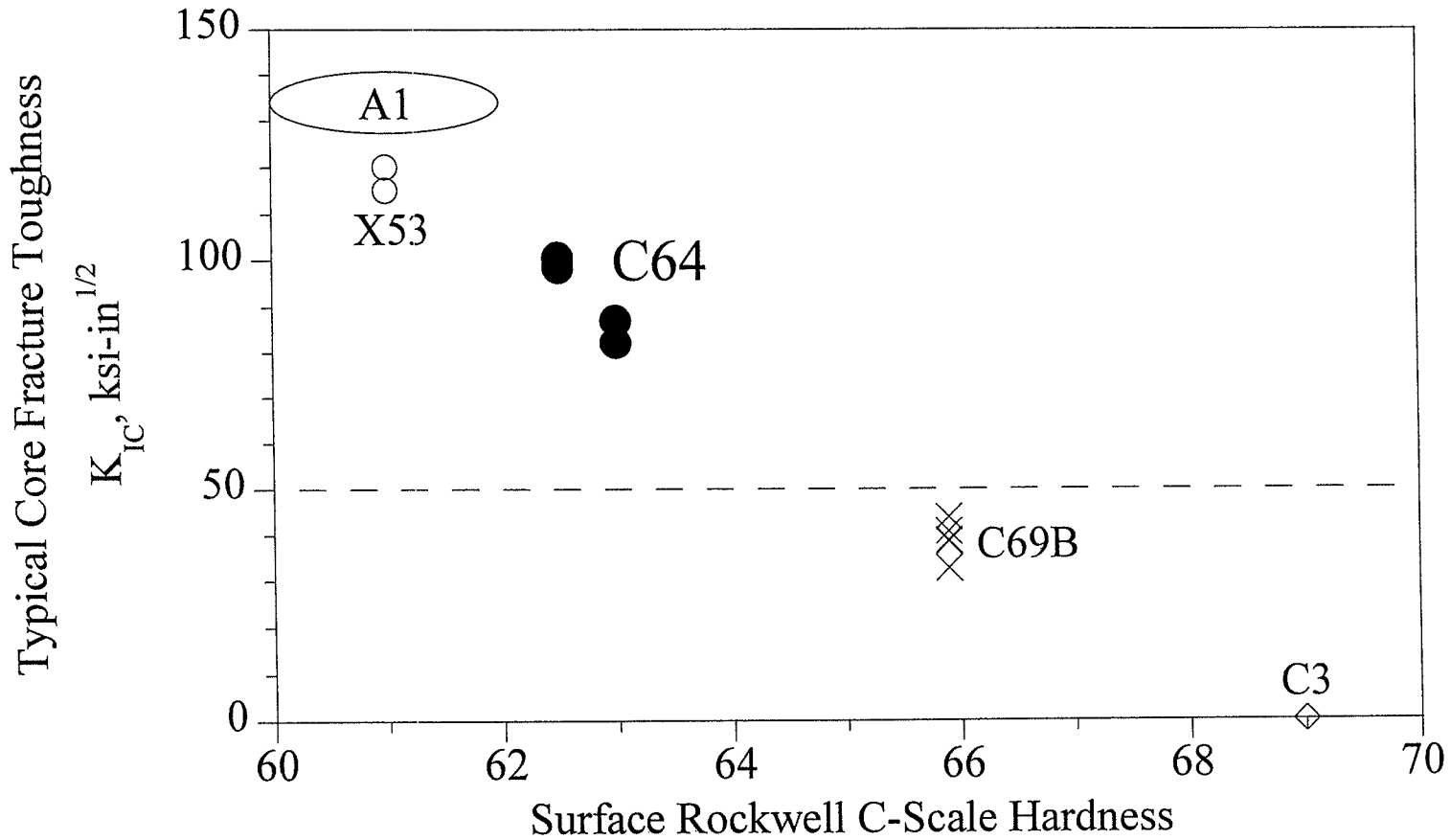
FIG. 3 is a graph plotting the maximum surface hardness and core fracture toughness of various steels possibly useful for power transmission gears. Typical embodiments of the claimed invention are also plotted and identified as alloy C64.
Figure 4:
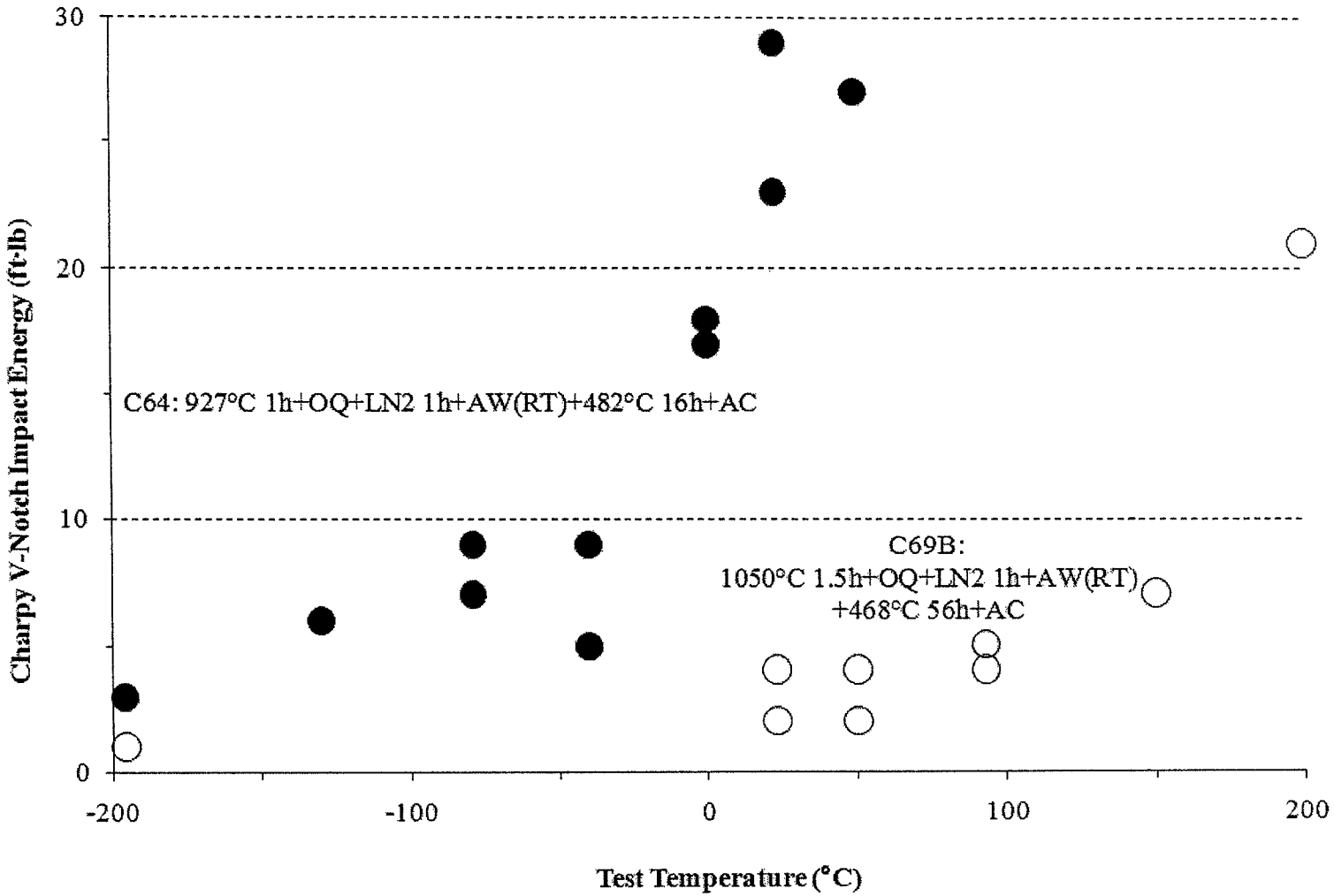
FIG. 4 is a graph plotting the Charpy V-Notch (CVN) impact energy of alloys C64 and C69B, in solid and open circles respectively, at various test temperatures.
Figure 5:
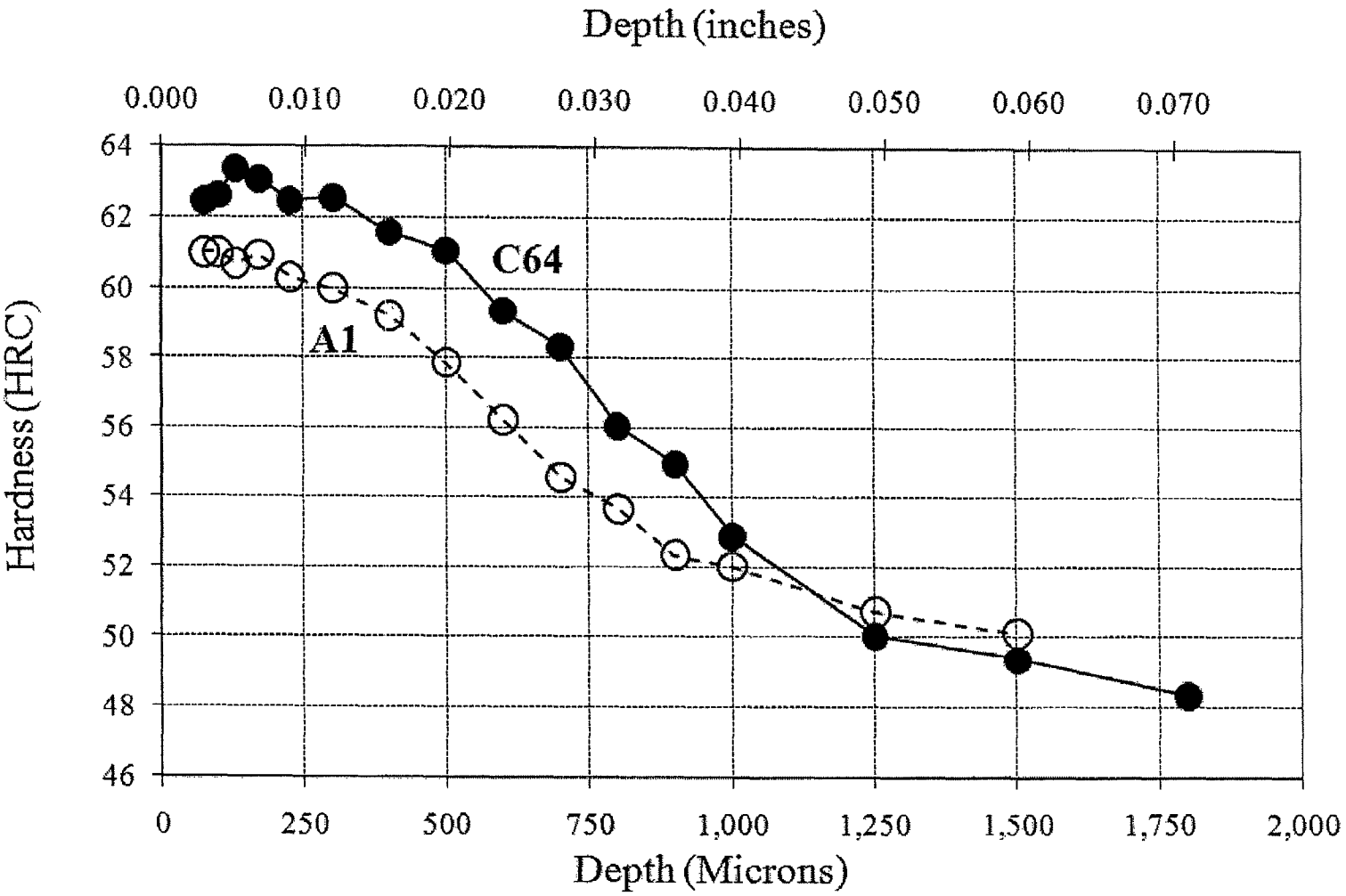
FIG. 5 is a graph depicting the hardness profile achieved for the carburized sample of alloy C64 and the alloy A1 of U.S. Pat. No. 6,464,801, in solid and open circles, respectively.

The steel comprises a predominantly lath martensitic matrix free of TCP-phases, and is strengthened by a fine-scale distribution of $M_2C$ carbides. In order to produce a predominantly lath martensitic matrix, the martensite-start temperature ($M_s$) must be higher than about 100° C. at the carburized surface. To this end, the invention has a carefully optimized the Ni content. While Ni is desirable for cleavage resistance, it also stabilizes austenite and thus, depresses $M_s$. The Ni content is chosen to place the ductile-to-brittle transition of the steel sufficiently below room temperature, preferably below −20° C., while maintaining a sufficiently high $M_s$. The Ductile-to-Brittle Transition Temperature (DBTT) of the steel can be characterized by measuring the CVN impact energy at varying temperatures. As shown in FIG. 3, while earlier prototype alloy C69B shows susceptibility to cleavage up to 150° C., the optimized composition of alloy C64 of the invention successfully depresses the DBTT to about −20° C.

To further enhance toughness, the average grain diameter must be less than about 50μ. To prevent undesirable grain growth during solution treatment, the steel employs a grain-pinning dispersion of MC particles, where M may be Ti, Nb, Zr, or V, with Ti preferred. To improve the grain-pinning efficiency, the particle size of the grain-pinning dispersion should be refined. A refined size of the MC particles is achieved by designing a system wherein the particles dissolve during homogenization and subsequently precipitate during forging. The MC particles remain stable during subsequent carburization and solution heat treatment cycles.

The resulting lath martensitic matrix is free of undesirable TCP-phases. TCP-phase precipitation is to be avoided during tempering because such phases can reduce the alloy ductility and toughness. The thermodynamic driving force for precipitation of TCP phases is limited in the invention by the contents of Cr, Mo, and W.

Following are examples of the experiments relating to development of the alloy of the invention:

Example 1

A 3,000-lb vacuum induction melt of Fe-16.1Co-4.5Cr-4.3Ni-1.8Mo-0.12C-0.1V-0.1W-0.02Ti (wt %) was prepared from high purity materials. The melt was converted to a 1.5-inch-square bar. The optimum processing condition was to solutionize at 1050° 90 minutes, quench with oil, immerse in liquid nitrogen for 1 hour, warm in air to room temperature, temper at 468° C. for 56 hours, and cool in air. The DBTT in this condition was between 150° C. and 250° C.

Example 2

A 30-lb vacuum induction melt of Fe-17.0Co-7.0Ni-3.5Cr-1.5Mo-0.2W-0.12C-0.03Ti (wt %) was prepared from high purity materials. $M_s$ of the case material was measured as 162° C. from dilatometry, in agreement with model predictions. The carburization response of this prototype was determined from hardness measurements. The optimum processing condition was to carburize and concurrently solutionize the steel at 927° C. for 1 hour, quench with oil, and immerse in liquid nitrogen. A subsequent tempering at 482° C. for 16 hours resulted in a surface-hardness of 62.5 HRC. The case depth of the carburized sample was about 1 mm. An atom-probe tomography analysis of the steel verified the absence of TCP phases.

Example 3

A 300-lb vacuum induction melt of Fe-17.0Co-7.0Ni-3.5Cr-1.5Mo-0.2W-0.12C (wt %) was prepared from high purity materials. Because this prototype did not include Ti, the grain-pinning dispersion of TiC particles could not form. As a result, the average grain diameter was 83μ and toughness was very low. The CVN impact energy of the core material from this prototype was 5 ft-lb at an Ultimate Tensile Strength (UTS) of 238 ksi.

Example 4

A second 300-lb vacuum induction melt of Fe-17.0Co-7.0Ni-3.5Cr-1.5Mo-0.2W-0.12C-0.03Ti (wt %) was prepared from high purity materials. This composition did include Ti, and the average grain diameter was 35μ. Toughness improved substantially. The CVN impact energy of the core material from this prototype was 23 ft·lb at a UTS of 238 ksi. The corresponding processing condition was to carburize and concurrently solutionize the steel at 927° C. for 8 hours, quench with oil, immerse in liquid nitrogen for 1 hour, temper at 496° C. for 8 hours, and cool in air. The fracture toughness in this condition was 100 ksi√in. The DBTT in this condition was around room temperature.

Example 5

A 10,000-lb vacuum induction melt of Fe-16.3Co-7.5Ni-3.5Cr-1.75Mo-0.2W-0.11C-0.03Ti-0.02V (wt %) was prepared from high purity materials. Half of the melt was converted to a 6.5-inch-diameter barstock, while the other half was converted to a 4.5-inch-diameter barstock. The optimum processing condition was to carburize the steel at 927° C. for 3 hours, cool in air, solutionize at 1000° C. for 40 minutes, quench with oil, immerse in liquid nitrogen for 2 hours, warm in air to room temperature, temper at 496° C. for 8 hours, and cool in air. The average grain diameter in this condition was 27μ and the fracture toughness was 85 ksi√in at a UTS of 228 ksi.

TABLE II

| | 1 | 2 | 3 | 4 | 5 (C64) |
|---|---|---|---|---|---|
| C | 0.12 | 0.12 | 0.12 | 0.12 | 0.11 |
| Co | 16.1 | 17.0 | 17.0 | 17.0 | 16.3 |
| Cr | 4.5 | 3.5 | 3.5 | 3.5 | 3.5 |
| Ni | 4.3 | 7.0 | 7.0 | 7.0 | 7.5 |
| Mo | 1.8 | 1.5 | 1.5 | 1.5 | 1.75 |
| V | 0.1 | | | | 0.02 |
| W | 0.1 | 0.2 | 0.2 | 0.2 | 0.2 |
| Ti | 0.02 | 0.03 | | 0.03 | 0.03 |
| Fe | Bal. | Bal. | Bal. | Bal. | Bal. |
| Average Grain Diameter (μ) | | | 83 | 35 | 27 |
| TCP | Absent | Absent | Absent | Absent | Absent |
| Fracture Toughness ksi√in | | | | 100 | 85 |
| UTS | | | 238 | 238 | 228 |
| HRC | | 62.5 | | | |
| DBTT (° C.) | 150-250 | | | 25 | |

Table II summarizes the information with respect to the examples set forth above and also indicates an embodiment of the invention (alloy C64). While an embodiment of the invention is disclosed, it is to be understood that the invention is to be limited only by the following claims and equivalents thereof.

What is claimed is:

1. A steel alloy comprising in weight percent:

about 3.5 Cr, 16.3 Co, 1.75 Mo, 7.5 Ni, 0.02 V, 0.20 W, 0.11 C, 0.03 Ti, and the balance Fe with a carburized case having a hardness of 62-64 HRC and a core having a core fracture toughness greater than 50 ksi√in at room temperature, wherein said alloy has a lath martensitic microstructure matrix essentially free of topologically close-packed (TCP) phases with $M_2C$ carbide precipitates, wherein M is W and may optionally further be selected from the group comprising Mo, Cr, and V.

2. The alloy of claim 1 wherein the alloy is in the form of an article of manufacture having a case thickness of about at least 1 mm.

3. The alloy of claim 1 wherein the alloy comprises a fine dispersion of grain pinning MC carbide particles, wherein M includes at least one selected from a group consisting of: Ti, Nb, Zr, and V.

4. The alloy of claim 1 wherein the alloy has a ductile-to-brittle transition temperature below room temperature.

5. The alloy of claim 4 wherein the alloy has a ductile-to-brittle transition temperature below −20° C.

6. A case-hardened steel alloy comprising in weight percent:

about 3.5 Cr, 16.3 Co, 1.75 Mo, 7.5 Ni, 0.02 V, 0.20 W, 0.11 C, 0.03 Ti, and the balance Fe with a carburized case having a hardness of 62-64 HRC and a core having a core fracture toughness greater than 50 ksi√in at room temperature wherein said alloy has a lath martensitic microstructure matrix essentially free of topologically close-packed (TCP) phases with $M_2C$ carbide precipitates, wherein M is W and may optionally further be selected from the group comprising Mo, Cr, and V.

7. The article of claim 6 wherein the alloy comprises a fine dispersion of grain pinning MC carbide particles, wherein M includes at least one selected from a group consisting of: Ti, Nb, Zr, and V.

8. The article of claim 6 wherein the alloy has a ductile-to-brittle transition temperature below room temperature.

* * * * *